US010792692B2

(12) United States Patent
Seo

(10) Patent No.: US 10,792,692 B2
(45) Date of Patent: Oct. 6, 2020

(54) ULTRASONIC HUMIDIFIER

(71) Applicant: MIRO CO. LTD., Incheon (KR)

(72) Inventor: Dong Jin Seo, Incheon (KR)

(73) Assignee: MIRO CO. LTD., Incheon (KR)

( * ) Notice: Subject to any disclaimer, the term of this patent is extended or adjusted under 35 U.S.C. 154(b) by 110 days.

(21) Appl. No.: 15/528,347

(22) PCT Filed: Nov. 13, 2015

(86) PCT No.: PCT/KR2015/012211
§ 371 (c)(1),
(2) Date: May 19, 2017

(87) PCT Pub. No.: WO2016/080706
PCT Pub. Date: May 26, 2016

(65) Prior Publication Data

US 2017/0304861 A1 Oct. 26, 2017

(30) Foreign Application Priority Data

Nov. 21, 2014 (KR) ..... 10-2014-0163353

(51) Int. Cl.
*B05B 17/06* (2006.01)
*B05B 17/00* (2006.01)
(Continued)

(52) U.S. Cl.
CPC ..... *B05B 17/0646* (2013.01); *B01F 3/0407* (2013.01); *F24F 6/12* (2013.01);
(Continued)

(58) Field of Classification Search
CPC ..... F24C 15/08; B05B 17/0646; B05B 17/06; B01F 3/0407; F24F 6/16; F24F 6/12;
(Continued)

(56) References Cited

U.S. PATENT DOCUMENTS 1,909,973 A * 5/1933 Lewis ..... F24F 6/02 392/406
2,435,325 A * 2/1948 Reichold ..... D06F 75/12 392/403
(Continued)

FOREIGN PATENT DOCUMENTS

CN 1455191 A 11/2003
CN 2633436 * 8/2004
(Continued)

OTHER PUBLICATIONS

EPO translation of Wang et al. CN 2633436 published Aug. 18, 2001 (Year: 2004).*
(Continued)

*Primary Examiner* — Stephen Hobson
(74) *Attorney, Agent, or Firm* — Novick, Kim & Lee, PLLC; Sang Ho Lee

(57) ABSTRACT

An ultrasonic humidifier according to an embodiment of the present invention includes: a water bottle accommodating water capable of generating humidification; a water bottle lid covering an upper opening surface of the water bottle and including a humidification outlet for discharging the humidification; and an ultrasonic humidification generating module which floats submersibly in the water accommodated in the water bottle and generates humidifying particles by using ultrasonic waves.

10 Claims, 6 Drawing Sheets

(51) Int. Cl.
*F24F 6/12* (2006.01)
*B01F 3/04* (2006.01)
*F24F 6/16* (2006.01)
*F24F 6/00* (2006.01)

(52) U.S. Cl.
CPC ..... *F24F 6/16* (2013.01); *B05B 17/06* (2013.01); *F24F 2006/008* (2013.01)

(58) Field of Classification Search
CPC ..... F24F 2006/008; F24F 11/89; F24F 11/58; F24F 2006/143; Y02B 30/80
See application file for complete search history.

(56) References Cited

U.S. PATENT DOCUMENTS 2,617,010 A * 11/1952 Schmitz ..... F22B 1/30 392/324
2,840,682 A * 6/1958 Rubenstein ..... F24H 1/00 392/337
2,875,314 A * 2/1959 Schreyer ..... F22B 1/284 392/406
3,301,998 A * 1/1967 Trickey ..... F24H 1/00 392/403
3,480,263 A * 11/1969 Davidson ..... F24F 6/06 261/29
3,584,192 A * 6/1971 Maag ..... F24F 6/025 392/406
3,864,437 A * 2/1975 Blaszkowski ..... F24F 6/04 261/24
3,883,923 A * 5/1975 England ..... A47B 91/06 16/42 R
3,936,283 A * 2/1976 Solis ..... B01D 47/16 96/222
4,624,806 A * 11/1986 Koszyk ..... F24F 6/16 141/114
4,699,737 A * 10/1987 Engstrand ..... F24F 6/16 261/120
5,485,828 A * 1/1996 Hauser ..... B05B 17/06 128/200.16
5,673,360 A * 9/1997 Scripps ..... F24F 6/025 220/8
5,693,270 A * 12/1997 Moore ..... A43B 3/0084 264/21
5,940,578 A * 8/1999 Goddard ..... B01D 1/0005 392/337
6,592,107 B1 * 7/2003 Wong ..... F24F 6/02 261/107
7,934,703 B2 * 5/2011 Tomono ..... A01M 1/205 261/18.1
9,377,208 B2 * 6/2016 Seo ..... B05B 17/0623
2003/0213374 A1 * 11/2003 Brady ..... A47J 37/0611 99/378
2011/0156288 A1 * 6/2011 Ahn ..... F24F 6/12 261/30
2011/0226868 A1 * 9/2011 Modlin ..... A01M 1/205 239/102.1
2017/0089596 A1 * 3/2017 Kim ..... F24F 6/12
2018/0135875 A1 * 5/2018 Seo ..... F24F 6/06
2018/0202672 A1 * 7/2018 Seo ..... F24F 6/00

FOREIGN PATENT DOCUMENTS

CN 102155774 A 8/2011
CN 102705963 A 10/2012
CN 202747528 * 2/2013
CN 203899832 * 10/2014
KR 20-1998-0057302 U 10/1998
KR 10-2009-0066365 A 6/2009
KR 10-2011-0066067 A 6/2011
KR 10-1268866 B1 5/2013
KR 10-2014-0001625 A 1/2014
KR 10-1374967 B1 3/2014

OTHER PUBLICATIONS

EPO translation of Xi et al. CN 203899832 published Oct. 29, 2014 and filed Apr. 4, 2014 (Year: 2014).*
EPO translation of Zhang et al. CN 202747528 published Feb. 20, 2013 (Year: 2013).*

* cited by examiner

ULTRASONIC HUMIDIFIER

TECHNICAL FIELD

Embodiments of the present invention relate to a humidifier, and more particularly, to an ultrasonic humidifier which can suppress propagation of bacteria by providing a structure which can be efficiently cleaned.

BACKGROUND ART

In general, a humidifier as a device for providing moisture to a dry room is divided into an ultrasonic humidifier using ultrasonic waves, a heating humidifier using a heater, a convection type evaporative humidifier, and the like according to a humidification method.

Among them, the ultrasonic humidifier is a type that sprays fine droplets in an atomized state by using a blowing fan, and the like after changing water into the fine droplets by using ultrasonic vibration of a vibrator installed in a water tank.

However, in general, since the ultrasonic humidifier has a structure in which a water bottle is mounted while being turned upside down, it is impossible to clean the inside of the ultrasonic humidifier properly and the resulting bacterial problem may cause a humidifier disinfectant problem.

Therefore, it is urgently required to develop an ultrasonic humidifier which can be perfectly cleaned and safely used without worrying about bacteria by adopting a structure in which the inside of the humidifier is easily cleaned.

DISCLOSURE

Technical Problem

An embodiment of the present invention provides an ultrasonic humidifier which provides a structure which is efficiently cleaned by producing humidifying particles through ultrasonic humidification and directly/indirectly discharging the produced humidifying particles to the outside while an ultrasonic humidifying module floats submersibly in a water tank including water to suppress propagation of bacteria.

The objects to be solved by the present invention are not limited to the aforementioned object(s), and other object(s), which are not mentioned above, will be apparent to a person having ordinary skill in the art from the following description.

Technical Solution

An ultrasonic humidifier according to an embodiment of the present invention includes: a water bottle accommodating water capable of generating humidification; a water bottle lid covering an upper opening surface of the water bottle and including a humidification outlet for discharging the humidification; and an ultrasonic humidification generating module which floats submersibly in the water accommodated in the water bottle and generates humidifying particles by using ultrasonic waves.

The ultrasonic humidifier according to an embodiment of the present invention may further include a humidification discharging fan directly or indirectly discharging the humidifying particles to the outside by controlling an air flow in the water bottle.

The humidification discharging fan may directly discharge the humidifying particles through the fan by controlling a rotational direction of the fan so that air flows out from the inside to the outside of the water bottle.

The humidification discharging fan may indirectly discharge the humidifying particles through the humidification outlet by controlling the rotational direction of the fan so that the air flows out from the outside to the inside of the water bottle.

The humidification discharging fan may be provided in the water bottle or the water bottle lid.

The ultrasonic humidification generating module may maintain a predetermined depth from a water surface of the water accommodated in the water bottle.

The ultrasonic humidification generating module may maintain a predetermined depth in connection with at least one of the water bottle, the water bottle lid, and a floating object which floats in the water.

The ultrasonic humidification generating module may include a wireless communication module so as to wirelessly control a humidification amount outside the water bottle.

The ultrasonic humidification generating module may be driven by wirelessly receiving power through wireless power transmission using the wireless communication module.

The wireless communication module may receive a remote control signal from an external controller including a remote controller or a portable terminal and perform an operation regarding humidification amount control or wireless power transmission based on the received remote control signal.

The water bottle lid may be joined with the water bottle by at least one type of a rotation type, a magnet type, and a forcible insertion type.

Detailed contents of other exemplary embodiments are included in the detailed description and the accompanying drawings.

Advantageous Effects

According to an embodiment of the present invention, a structure is provided, which is efficiently cleaned by producing humidifying particles through ultrasonic humidification and directly/indirectly discharging the produced humidifying particles to the outside while an ultrasonic humidifying module floats submersibly in a water tank including water to suppress propagation of bacteria.

According to the embodiment of the present invention, only fine humidifying particles are discharged by adopting an indirect discharge method using a fan to maximize humidifying performance and greatly enhance even durability of the fan.

BEST MODE

Figure 1:
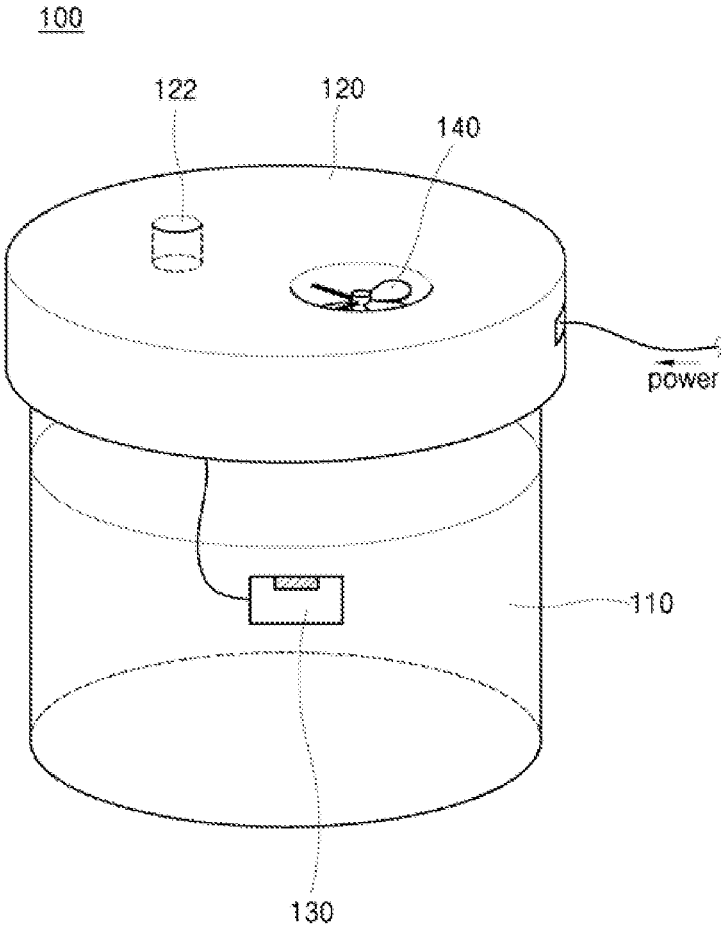
FIG. 1 is a perspective view of an ultrasonic humidifier according to an embodiment of the present invention.

Advantages and/or features of the present invention, and a method for achieving the advantages and/or features will become obvious with reference to embodiments to be described below in detail together with the accompanying drawings. However, the present invention is not limited to the embodiments set forth below, and will be embodied in various different forms. The present embodiments are just for rendering the disclosure of the present invention complete and are set forth to provide a complete understanding of the scope of the invention to a person with ordinary skill in the technical field to which the present invention pertains, and the present invention will only be defined by the scope of the claims. Like reference numerals refer to like elements throughout the specification.

Hereinafter, embodiments of the present invention will be described in detail with reference to the accompanying drawings.

Figure 2:
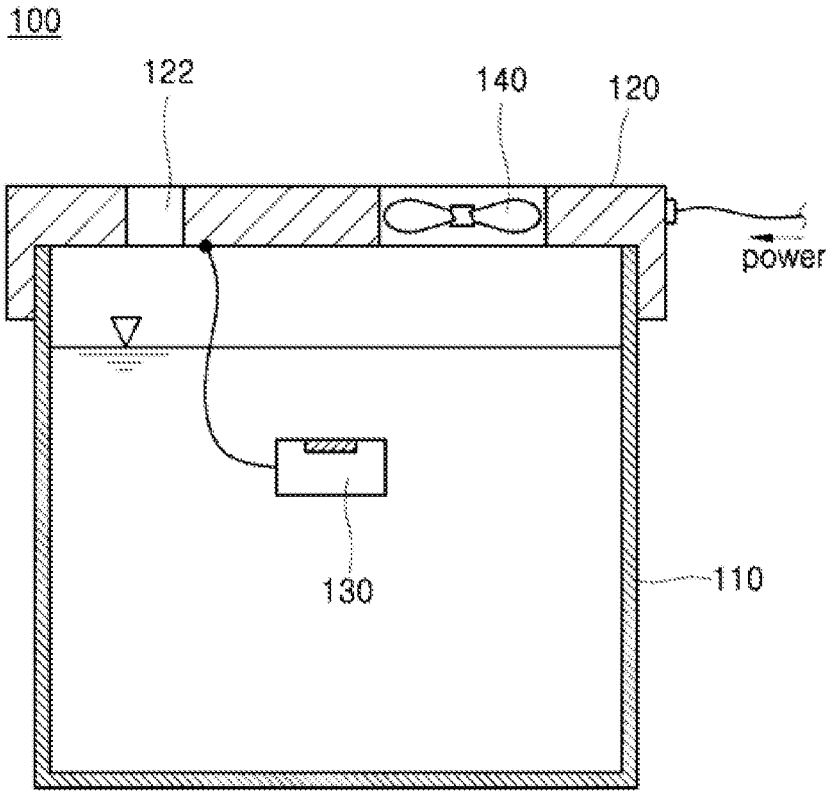
FIG. 2 is a side cross-sectional view of the ultrasonic humidifier according to the embodiment of the present invention.

FIG. 1 is a perspective view of an ultrasonic humidifier according to an embodiment of the present invention and FIG. 2 is a side cross-sectional view of the ultrasonic humidifier according to the embodiment of the present invention.

As illustrated in FIGS. 1 and 2, an ultrasonic humidifier 100 according to the embodiment of the present invention is configured to include a water bottle 110, a water bottle lid 120, an ultrasonic humidification generating module 130, and a humidification discharging fan 140.

The water bottle 110 is a water tank including an accommodation space capable of accommodating water which will generate humidification. Since the water bottle 110 is designed in a structure in which the water is accommodated in an internal accommodation space, the water bottle 110 does not fall down even by an external impact, thereby providing stability. The water bottle 110 may be formed in a cylindrical shape as illustrated in FIG. 1 and formed in various shapes as necessary. For example, the water bottle 110 is formed in a hexahedron shape of which a cross section is quadrangular.

The water bottle lid 120 serves as a cover that covers an upper opening plane of the water bottle. The water bottle lid 120 may prevent the water from being poured at one time by an abrupt external impact and minimize foreign materials including dust, and the like to flow into the water bottle 110.

The water bottle lid 120 may be formed in a shape corresponding to the shape of the water bottle 110. For example, as illustrated in FIG. 1, when the water bottle 110 is formed in the cylindrical shape, the water bottle lid 120 may be formed in a circular shape. Further, when the water bottle 110 is formed in the hexahedron shape, the water bottle lid 120 may be formed in a quadrangular shape.

The water bottle lid 120 may be joined with the water bottle 110 in at least one type of a rotation type, a magnet type, and a forcible insertion type. Since the schemes are known technologies which have already been widely known in the same technical field, the description thereof will be omitted in the embodiment.

The water bottle lid 120 includes a humidification outlet 122 for discharging humidification. The humidification outlet 122 serves to discharge humidifying particles generated from the inside of the water bottle 110 to the outside.

The humidification outlet 122 may be formed by a circular hole as illustrated in FIG. 1 and besides, formed in various shapes including a triangle, a quadrangle, a polygon, and the like.

The ultrasonic humidification generating module 130 floats submersibly in the water accommodated in the water bottle 110 and generates the humidifying particles by using ultrasonic waves. In this case, the ultrasonic humidification generating module 130 may generate the humidifying particles while maintaining a predetermined depth from a water surface of the water accommodated in the water bottle 110.

That is, the ultrasonic humidification generating module 130 may generate the humidifying particles while maintaining a predetermined depth through a floating object which is integrally formed and on the other hand, maintain a predetermined depth in connection with at least one of the water bottle 110, the water bottle lid 120, and the floating object which floats in the water through a bridge. Herein, the bridge may be formed in various shapes as necessary, which include a flexible line shape, a fixed line shape, and the like.

Hereinafter, a structure of the ultrasonic humidification generating module 130 will be described in detail with reference to FIGS. 3 to 5. For reference, FIG. 3 is a perspective view illustrating an embodiment of an ultrasonic humidification generating module 130, FIG. 4 is a side cross-sectional view illustrating the embodiment of the ultrasonic humidification generating module 130, and FIG. 5 is a side cross-sectional view illustrating another embodiment of the ultrasonic humidification generating module 130.

Figure 3:
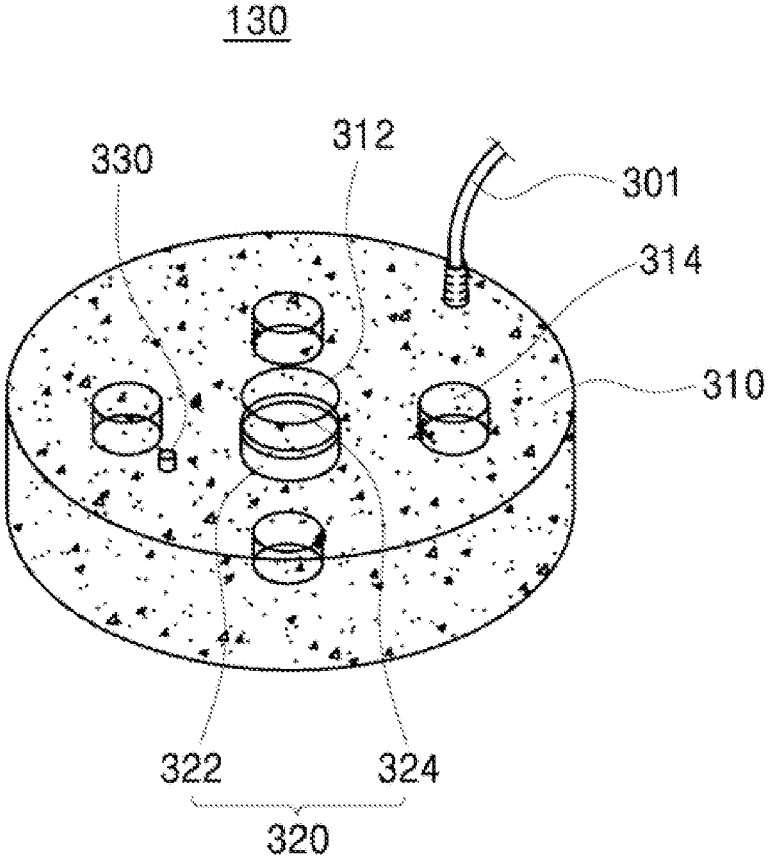
FIG. 3 is a perspective view illustrating an embodiment of an ultrasonic humidification generating module in the embodiment of the present invention.
Figure 4:
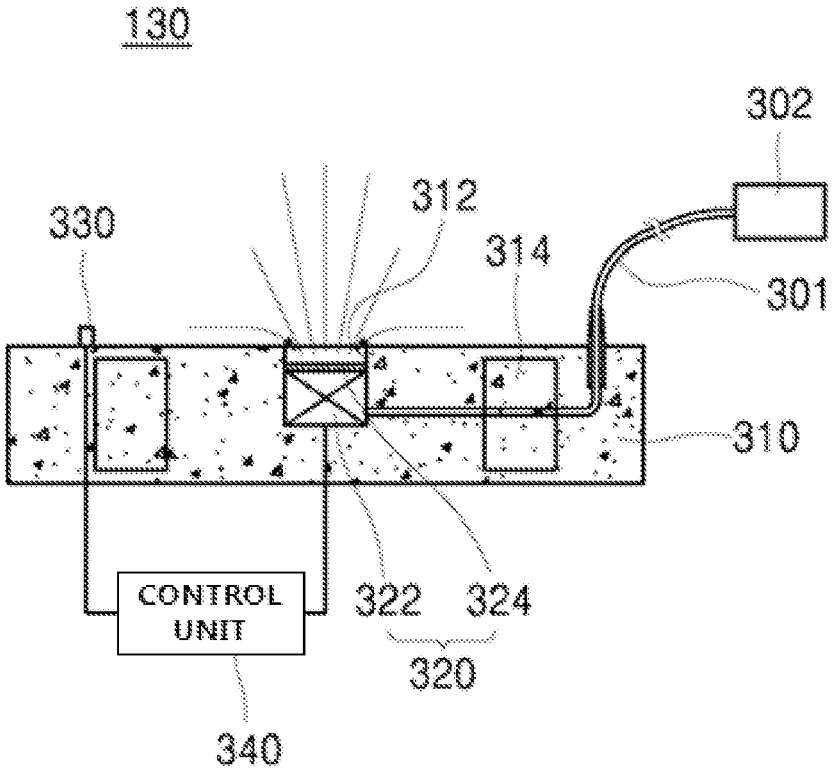
FIG. 4 is a side cross-sectional view illustrating the embodiment of the ultrasonic humidification generating module in the embodiment of the present invention.
Figure 5:
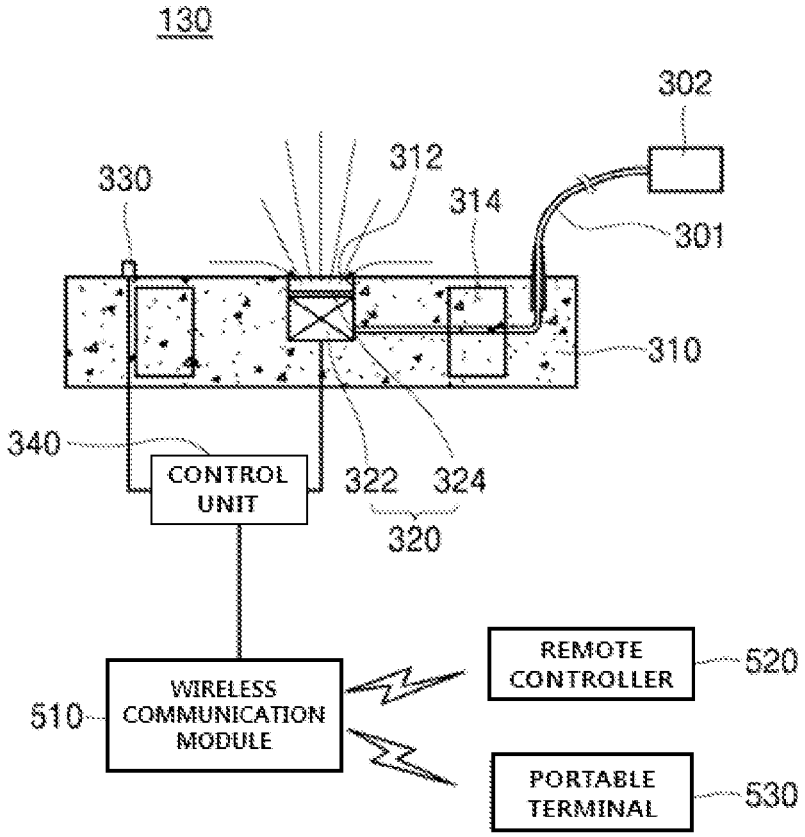
FIG. 5 is a side cross-sectional view illustrating another embodiment of the ultrasonic humidification generating module in the embodiment of the present invention.

First, referring to FIGS. 3 and 4, the ultrasonic humidification generating module 130 may be configured to include a buoyancy object 310, an ultrasonic vibration unit 320, a sensor 330, and a control unit 340.

The buoyancy object 310 which has predetermined buoyancy so as to float in the water floats submersibly in the water accommodated in the water bottle 110 illustrated in FIGS. 1 and 2. Herein, the buoyancy object 310 may have a disk shape as illustrated in FIG. 3, but the shape of the buoyancy object 310 may be manufactured in various shapes as necessary in respect to the shape of the buoyancy object 310.

The buoyancy object 310 may include an inflow groove 312 so that the water may flow in the top thereof. The inflow groove 312 may be formed to be concave. The inflow groove 312 is illustrated in the circular shape in FIG. 3, but the shape of the inflow groove 312 may be variously applied as necessary.

A specific gravity of the buoyancy object 310 is preferably 1 or less so that the buoyancy object 310 has a lower specific gravity than the water. As a result, the top of the buoyancy object 310 may be positioned to be lower than the water surface by 2 to 3 cm.

The buoyancy object 310 may further include one or multiple space parts 314 for forming buoyancy in a thickness. The space part 314 may vary the buoyancy of the buoyancy object 310 by controlling the number of space parts 314 and an internal cross-sectional area. As a result, the position of the buoyancy object 310 may be more precisely controlled.

The buoyancy object 310 may be made of a material having the buoyancy. For example, the buoyancy object 310 may be manufactured by materials including a synthetic resin, Styrofoam, and the like.

The ultrasonic vibration unit 320 which operates by power transferred from the outside to generate ultrasonic vibration may be installed a lower bottom portion of the inflow groove 312 provided in the buoyancy object 310.

The ultrasonic vibration unit 320 atomizes the water which flows into the inflow groove 312 by the ultrasonic vibration at the time of transferring the power from the outside (a power supply source 302 such as an electric outlet) through a cable 301. For reference, the cable 301 may extend with a predetermined length and one end of the cable 301 may be electrically connected to the ultrasonic vibration unit 320 through a top border portion of the buoyancy object 310.

In detail, the ultrasonic vibration unit 320 may include a vibration plate 322 and a vibrator 324.

The vibration plate 322 may be installed on a bottom surface of the inflow groove 312 and is driven by the power transferred from the outside to generate the ultrasonic vibration.

The vibrator 324 may be installed while being in close contact with the top of the vibration plate 322 and manufactured in the disk shape by using a ceramic material, and the like. The vibrator 324 is vibrated by the ultrasonic vibration of the vibration plate 322 to atomize the water in the inflow groove 312 to the top and in this case, atomized moisture particles (humidifying particles) may be sprayed upward through the water surface.

The sensor 330 installed in the buoyancy object 310 may sense that the water comes up to the top of the buoyancy object 310.

That is, the sensor 330 installed on the top of the buoyancy object 310 may sense the water that moves to an inlet portion of the inflow groove 312 along the top of the buoyancy object 310. In this case, when the water is sensed, the sensor 330 may generate a sensed signal and transfer the generated signal to the control unit 340.

The control unit 340 may be electrically connected with the sensor 330 and receives the sensed signal from the sensor 330 to drive the vibration plate 322.

In this case, the control unit 340 varies a driving strength of the vibration plate 322 according to an input signal input from the outside to control an atomization amount of the ultrasonic vibration unit 320.

An operation unit (not illustrated) may be connected to the control unit 340 so as to control power on/off, the atomization amount, a timer, and the like and a display unit (not illustrated) which may display current state information to the outside may be further connected to the control unit 340.

Meanwhile, as illustrated in FIG. 5, the ultrasonic humidification generating module 130 may further include a wireless communication module 510 so as to control a humidification amount wirelessly outside the water bottle 110.

Further, the ultrasonic humidification generating module 130 may be driven by receiving the power wirelessly through wireless power transmission using the wireless communication module 510.

To this end, the wireless communication module 510 may receive a remote control signal from external controllers including a remote controller 520, a portable terminal 530, and the like. The wireless communication module 510 may perform operations regarding humidification amount control, wireless power transmission, and the like based on the received remote control signal.

Referring back to FIGS. 1 and 2, the humidification discharging fan 140 directly or indirectly discharges the humidifying particles generated by the ultrasonic humidification generating module 130 to the outside by controlling an air flow in the water bottle 110. In this case, a rotation direction of the humidification discharging fan 140 may be controlled differently according to a discharge method.

That is, the humidification discharging fan 140 may directly discharge the humidifying particles to the outside by controlling the rotational direction of the fan so that air flows out from the inside to the outside of the water bottle 110.

Further, the humidification discharging fan 140 may indirectly discharge the humidifying particles through the humidification outlet 122 by controlling the rotational direction of the fan so that the air flows from the outside to the inside of the water bottle 110.

The humidification discharging fan 140 may be provided in the water bottle lid 120 and the humidification discharging fan 140 may be water-proofed through coating of a waterproof material, or the like so as to provide against a failure depending on a contact with the water accommodated in the water bottle 110, and the like.

Figure 6:
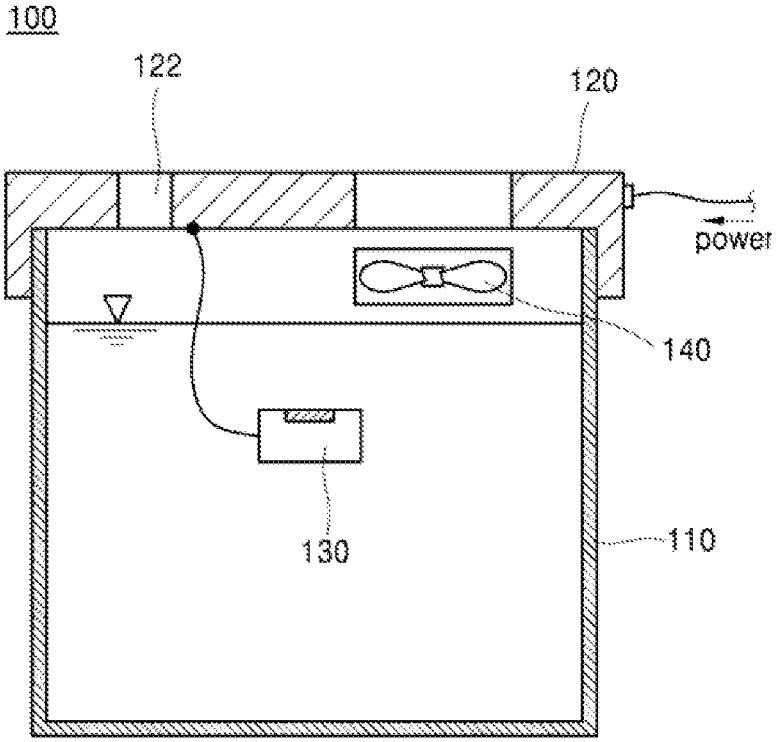
FIG. 6 is a side cross-sectional view of an ultrasonic humidifier according to another embodiment of the present invention.

Meanwhile, as illustrated in FIG. 6, the humidification discharging fan 140 may be provided on the side of the water bottle 110. When the humidification discharging fan 140 is provided on the side of the water bottle 110, the humidification discharging fan 140 is preferably installed at a higher position than a water level of the water accommodated in the water bottle 110. For reference, FIG. 6 is a side cross-sectional view of an ultrasonic humidifier according to another embodiment of the present invention.

Although the detailed embodiments of the present invention have been described up to now, various modifications of the present invention can be made without departing from the scope of the present invention. Therefore, the scope of the present invention should not be limited to the embodiments and should be defined by the appended claims and equivalents to the appended claims.

The invention claimed is:

1. An ultrasonic humidifier comprising:

a water bottle accommodating water capable of generating humidification;

a water bottle lid covering an upper opening surface of the water bottle and including a humidification outlet for discharging the humidification;

an ultrasonic humidification generating module floating submersibly in the water accommodated in the water bottle and generating humidifying particles by using ultrasonic waves; and a humidification discharging fan directly and indirectly discharging the humidifying particles to the outside by controlling an air flow in the water bottle, wherein the ultrasonic humidification generating module includes a buoyancy object, an ultrasonic vibration unit, a sensor, and a control unit, wherein the sensor installed on top of the buoyancy object is configured to sense water that moves to an inlet portion of an inflow groove along the top of the buoyancy object, and wherein the control unit drives an ultrasonic vibration unit when the control unit receives a sensed signal from the sensor.

2. The ultrasonic humidifier of claim 1, wherein the humidification discharging fan directly discharges the humidifying particles through the fan by controlling a rotational direction of the fan so that air flows out from the inside to the outside of the water bottle.

3. The ultrasonic humidifier of claim 1, wherein the humidification discharging fan indirectly discharges the humidifying particles through the humidification outlet by controlling a rotational direction of the fan so that the air flows from the outside to the inside of the water bottle.

4. The ultrasonic humidifier of claim 1, wherein the humidification discharging fan is provided in the water bottle or the water bottle lid.

5. The ultrasonic humidifier of claim 1, wherein the ultrasonic humidification generating module maintains a predetermined depth from a water surface of the water accommodated in the water bottle.

6. The ultrasonic humidifier of claim 5, wherein the ultrasonic humidification generating module maintains the predetermined depth in connection with at least one of the water bottle, the water bottle lid, and a floating object which floats in the water.

7. The ultrasonic humidifier of claim 1, wherein the ultrasonic humidification generating module includes a wireless communication module configured to wirelessly control a humidification amount outside the water bottle.

8. The ultrasonic humidifier of claim 7, wherein the ultrasonic humidification generating module is driven by wirelessly receiving power through wireless power transmission using the wireless communication module.

9. The ultrasonic humidifier of claim 8, wherein the wireless communication module receives a remote control signal from an external controller including a remote controller or a portable terminal and performs an operation regarding humidification amount control or wireless power transmission based on the received remote control signal.

10. The ultrasonic humidifier of claim 1, wherein the water bottle lid is joined with the water bottle by at least one type of a rotation type, a magnet type, and a forcible insertion type.

* * * * *